US006676467B1

(12) United States Patent
Filsouf

(10) Patent No.: US 6,676,467 B1
(45) Date of Patent: Jan. 13, 2004

(54) SAFETY AIRBAG FOR SWIMMERS

(76) Inventor: Ehsan Filsouf, 8590 SW. 168 Ter., Miami, FL (US) 33157

( * ) Notice: Subject to any disclaimer, the term of this patent is extended or adjusted under 35 U.S.C. 154(b) by 0 days.

(21) Appl. No.: 10/244,554

(22) Filed: Sep. 17, 2002

(51) Int. Cl.[7] ..... B63C 9/15
(52) U.S. Cl. ..... 441/90; 441/106
(58) Field of Search ..... 441/88, 90, 108, 441/106, 122, 123

(56) References Cited

U.S. PATENT DOCUMENTS

| | | | | | |
|---|---|---|---|---|---|
| 906,340 | A | * | 1/1908 | Uherkocz | 441/90 |
| 981,788 | A | * | 1/1911 | Nekarda | 441/90 |
| 1,416,523 | A | * | 5/1922 | Strobel | 441/90 |
| 1,833,614 | A | * | 11/1931 | Matuskey | 441/90 |
| 1,853,386 | A | | 4/1932 | Sutton | 441/102 |
| 1,956,890 | A | | 5/1934 | Buxton | 441/102 |
| 2,326,987 | A | * | 8/1943 | Weinheimer | 441/90 |
| 3,134,993 | A | * | 6/1964 | McCoy | 441/102 |
| 3,681,800 | A | * | 8/1972 | Thoma | 441/120 |
| 3,935,608 | A | * | 2/1976 | Freedman et al. | 441/92 |
| 5,178,569 | A | * | 1/1993 | Wang | 441/93 |
| 5,466,179 | A | * | 11/1995 | Jeffrey, Sr. | 441/108 |
| 5,685,752 | A | * | 11/1997 | Fulton, Jr. | 441/90 |
| 6,231,411 | B1 | * | 5/2001 | Vinay | 441/88 |

* cited by examiner

*Primary Examiner*—S. Joseph Morano
*Assistant Examiner*—Lars A Olson
(74) *Attorney, Agent, or Firm*—Siemens Patent Services, LLC

(57) ABSTRACT

The present invention features an airbag to be worn by swimmers for safety. The airbag device generally relates to personal floatation in the water and more particularly comprises, a plastic inflatable airbag, an air filling tube for filling or draining air, and an air check valve. The airbag is inflated by the wearer's breath, or in an alternate embodiment, an electrical air pump or compressed gas cartridge or gas generated by a chemical reaction. The airbag is worn around the lower abdomen (for the male wearer) or placed on the ribs or breast (for the female wearer). The airbag is worn underneath the swimming apparel and is practically invisible to an onlooker. The airbag can be made in smaller sizes to be worn in other parts of the swimmer's body (such as the neck) along with the main airbag for enhancing buoyancy. When the swimmer is not inside the water, the inventive safety airbag can be comfortably deflated allowing the wearer to perform other tasks such as walking or eating, with ease. Since the inventive safety airbag is fastened firmly encircling the body with a secure fitting around the wearer's abdomen and/or waist, therefore avoiding slip offs.

14 Claims, 8 Drawing Sheets

SAFETY AIRBAG FOR SWIMMERS

FIELD OF THE INVENTION

The present invention relates to an aquatic safety apparatus and, more particularly, to an airbag device worn by swimmers.

BACKGROUND OF THE INVENTION

DISCUSSION OF THE PRIOR ART

The prior art contains devices that are worn by swimmers that facilitate floatation. Three of these devices are disclosed in U.S. Pat. No. 1,956,890 to Buxton; U.S. Pat. No. 1,853,386 to Sutton; and U.S. Pat No. 3,134,993 to McCoy.

The U.S. Patent to Buxton discloses apparel that is buoyant for wear that primarily prevents submersion during wear. It is not designed for the use by swimmers. The U.S. Patent to Sutton also discloses a buoyant garment with inflatable air tubes that form an airproof and waterproof garment. The garment is slipped over the head of the wearer and the side edges connect so as to provide a garment worn on the waist area having neck and arm openings. The garment is readily visible and maintains a style that departs from the present invention. The McCoy invention is directed toward an air inflating attachment for swimsuits. This attachment may be adapted for wear by both male and female users and is designed for attachment to the swimsuit of the wearer.

None of these patents either teaches or suggests a swimmer's safety airbag for use under swimming apparel comprised of a multi-layer airbag having welded sections being connected to an air tube with air check valves, and air pressure sensors, etc. As will be seen in greater detail hereinafter, the present invention involves a more detailed airbag device not present in any of the prior art.

SUMMARY OF THE INVENTION

The present invention features an airbag to be worn by swimmers for safety. The airbag device generally relates to personal floatation in the water and more particularly comprises, a plastic inflatable airbag, an air filling tube for filling or draining air, and an air check valve. The airbag is worn around the lower abdomen (for the male wearer) or placed on the ribs or breast (for the female wearer).

The inventive airbag is designed in such a manner to provide myriad of advantages over traditionally worn water safety articles. For instance, the airbag is worn underneath the swimming apparel and is practically invisible to an onlooker. When the swimmer is not inside the water, the inventive safety airbag can be comfortably deflated allowing the wearer to perform other tasks such as walking or eating, with ease. In the case of the present invention, such rudimentary tasks are performed much easier, than with traditional safety articles such as life jackets, and the sort. The airbag is inflated by the wearer's breath, or in an alternate embodiment, an electrical air pump or compressed gas cartridge or gas generated from a chemical reaction within a cartridge. Since the inventive safety airbag is fastened firmly encircling the body with a secure fitting around the wearer's abdomen and/or waist, therefore avoiding slip offs.

It is therefore an object of the invention to provide a lightweight and comfortable safety airbag for swimmers.

It is another object of the invention to provide a safety airbag for swimmers that can be worn under swimming apparel.

It is also an object of the invention to provide a flotation device with self-inflatable airbag and air filling tube.

It is a further object of the invention to provide a safety airbag for swimmers that can be adapted for wearing by both genders.

It is an additional object of the invention to provide a safety airbag for swimmers providing enhanced safety, having an air check valve and a pressure gauge.

It is still further object of the invention to provide a safety airbag for swimmers wherein the airbag is specifically designed to be substantially flat when deflated such that it is not readily visible when worn.

It is an additional object of the invention to provide a safety airbag for swimmers that can be readily inflated at any time during swimming.

It is an additional object of the invention to provide a safety airbag for swimmers that can be variably and/or adjustably filled with air for different skill levels of the swimmers.

It is a further object of the invention to provide a safety airbag for swimmers adapted for different levels of inflation therefore adapting to different skill levels and capable of accessing various swimming techniques.

It is an additional object of the invention to provide a safety airbag for swimmers that can serve as a flotation device when filled to maximum capacity.

It is an additional object of the invention to provide a safety airbag for swimmers that can be readily inflated and deflated for repeated use.

It is an additional object of the invention to provide a safety airbag for swimmers that may be inflated by an electric pump, or compressed air cartridge or gas generated from a chemical reaction within a cartridge.

It is an additional object of the invention to provide complete buoyancy when swimmer wears the airbag.

These and other objects, features and advantages will be more apparent from a study of the enclosed text and the appended drawings.

BRIEF DESCRIPTION OF THE DRAWINGS

A complete understanding of the present invention may be obtained by reference to the accompanying drawings, when taken in conjunction with the detail description thereof and in which.

DESCRIPTION OF THE PREFERRED EMBODIMENT

This disclosure of the invention is submitted in furtherance of the constitutional purposes of the U.S. Patent Laws "to promote the progress of science and useful arts" (Article 1, Section 8).

Figures 1, 2:
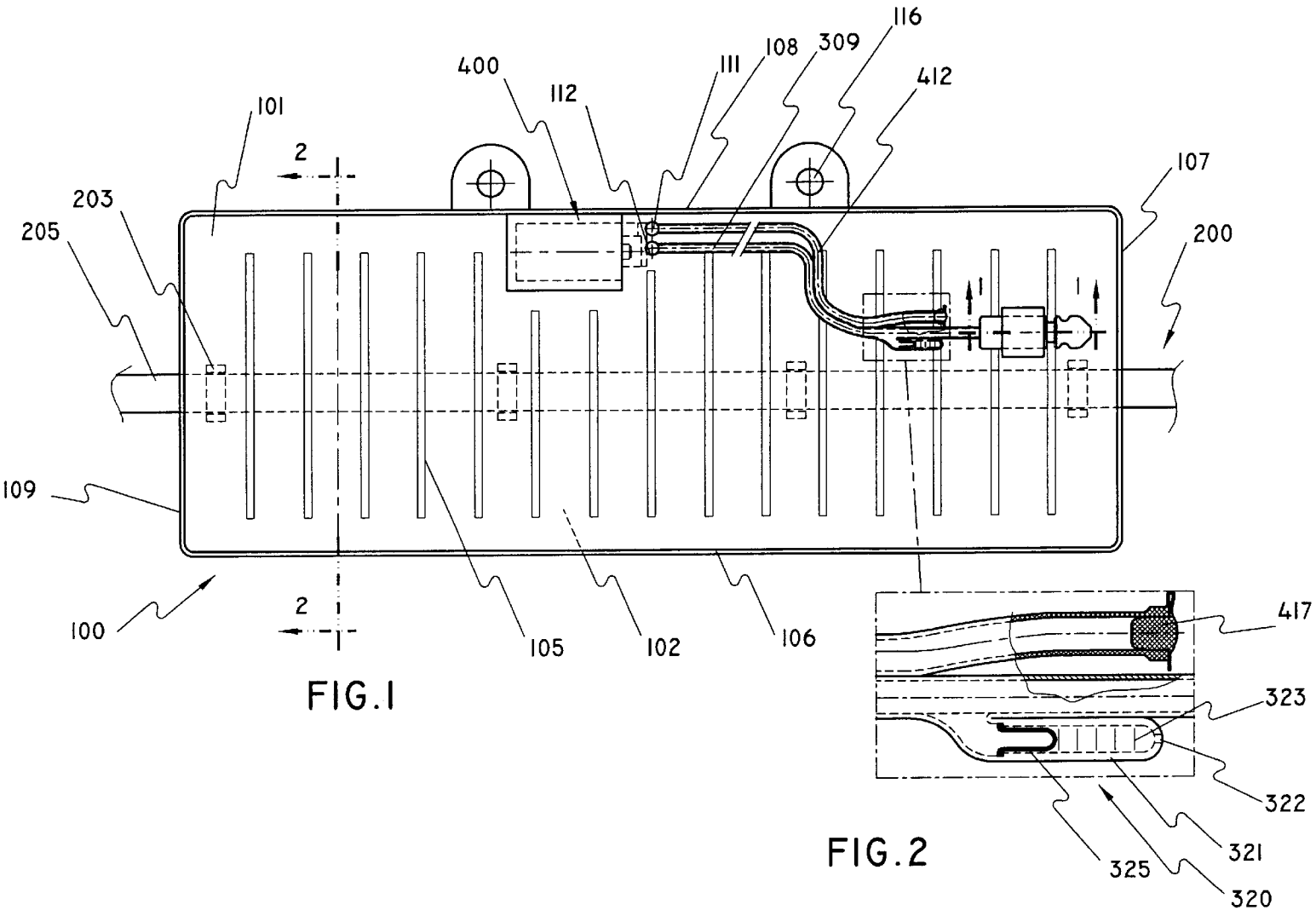
FIG. 1 is a front view of the bottom half of the safety airbag.
FIG. 2 is a detailed drawing of the pressure gauge in accordance with the present invention.

The present invention is directed toward a device for personal flotation in the water and is indicated generally by 100 in FIG. 1. The airbag 100 comprises an attachment mechanism 200, and an air filing mechanism 300.

Figure 3:
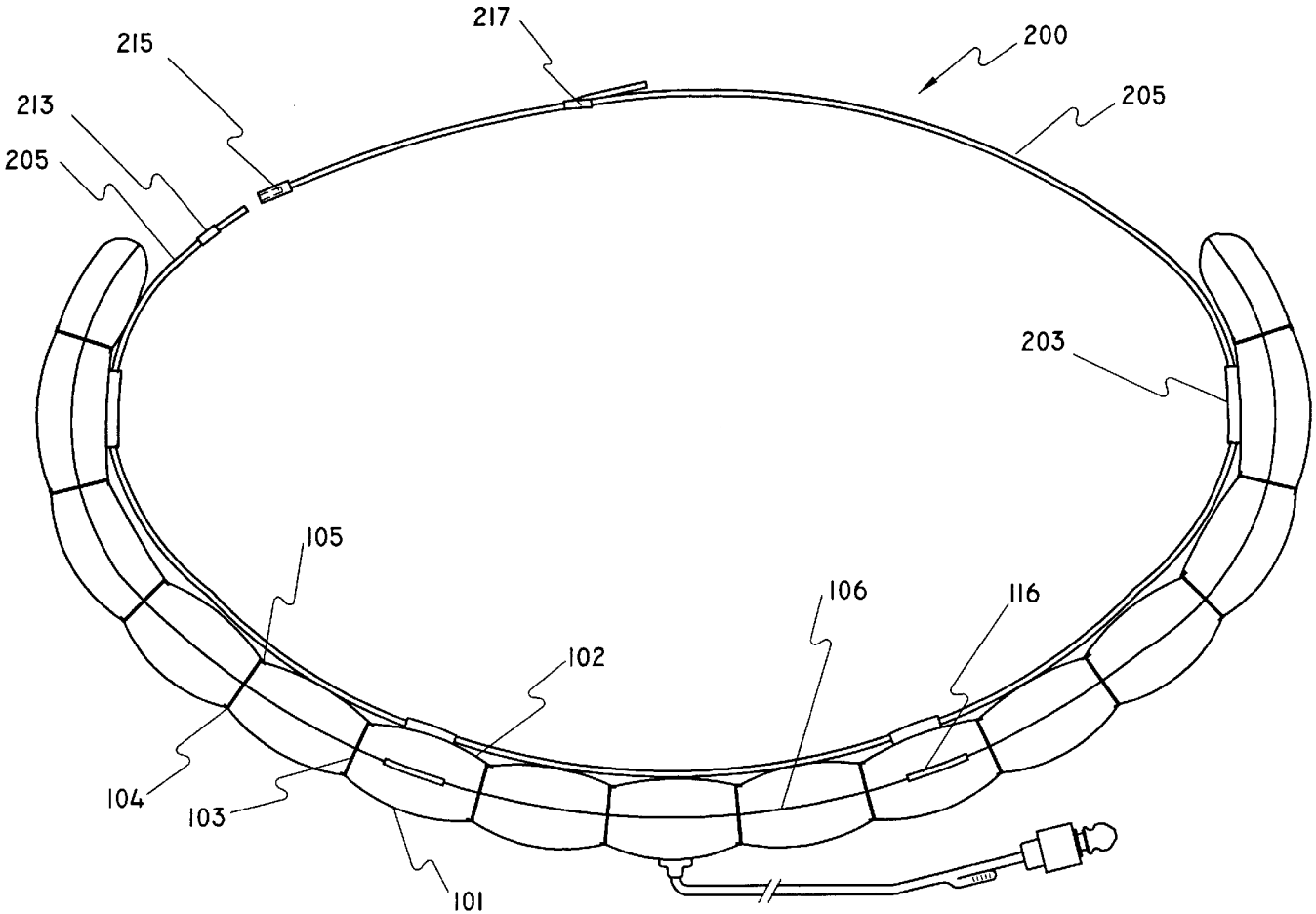
FIG. 3 is a top view of the present invention (in an inflated state).

The airbag 100 is made of a durable, flexible sheet of material, such as but not limited to plastic, e.g., PVC and/or rubber or composition of plastic and rubber to be reinforced by acrylic cords. The airbag 100 is substantially of hollow rectangular prism-like form when inflated. The airbag 100 is comprised of two layers, a top layer 101 and a bottom layer 102, as shown in FIGS. 1 and 3.

These thin layers may be of a thickness approximately between 0.20 to 0.40 millimeters. Located between the top and bottom layers, 101 and 102, respectively, is another interior flexible sheet 103. The layers 101 and 102 are welded together along a periphery thereof along weld lines 106–109 which define the outer edges of the airbag 100. The interior sheet 103 is used to provide air pockets between the top and bottom layers 101 and 102.

Figure 6:
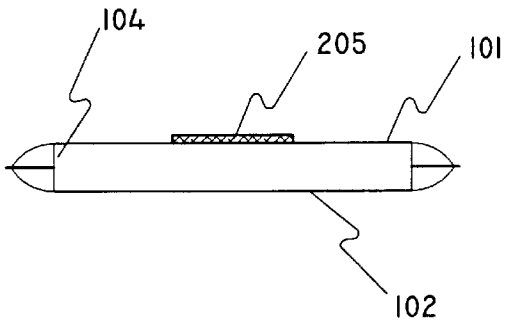
FIG. 6 is the cross sectional view of the present invention (in inflated state) taken from line 2—2 of FIG. 1.

The airbag 100 is quite flat when deflated. However, when the airbag 100 is inflated, the air pockets, formed by welded sheet 103, will keep the top and bottom layers 101 and 102 apart from each other at a predetermined distance (i.e., inflated height). The layers 101 and 102 are welded such that when inflated, the airbag 100 remains substantially flat and not exceeding an inflated height of 5 cm, for example. These weld lines (106–109) are located at a predetermined distance from one another to ensure appropriate shape. FIG. 6 shows a cross sectional view of the airbag 100 with sheets 101 and 102 welded together with the air bag in an inflated state.

The internal sheet layer 103 may be welded together with the external sheet top layer 101 and the external sheet bottom layer 102 in different styles or the external sheet top layer 101 and the bottom layer 102 can be welded to each other in parallel lines at a certain distance from each other. For example, FIG. 3 shows the series of interior weld lines 104 and 105. Each internal sheet layer 103 is welded to the top layer 101 at weld line 104 and to the bottom layer 102 at weld line 105 to form a prism-like, parallelogram shape with rectangular sections, as can be seen in FIG. 3. These weld lines 104 and 105 form the air pockets within the airbag 100 and ensure appropriate inflation rates. However, the welding of the flexible sheets may take on other forms.

The airbag 100 is attached to the body of a wearer by attachment means 200 (shown illustratively at FIGS. 1 and 3). The components of the attachment means 200 are best shown on FIG. 3. At least one flexible fastening strap 205 is located on the rear side of the airbag 100, i.e., the back of flexible layer 102 of the airbag 100.

The fastening strap 205 is attached to the back layer 102 by a plurality of strap holders 203 which are welded thereto. At either ends of the strap 205 are female clip end 215 and male clip end 213 for fastening the ends of the flexible fastening strap 205. The male clip end 213 and female clip end 215 are configured to matingly connect to one another for closure. The length of the strap 205 may be adjusted for comfort and snug fitting by an adjustment clamp 217 located on the strap 205.

This way of attachment and adjustment is advantageous in that it allows adjustment without undue damage to the airbag 100. The strap holders 203 are also designed in such a manner as to allow strap 205 to slide inside the strap holder 203, thereby allowing gross adjustment of the airbag 100 along the length of the strap for desired position and placement of the safety device onto the body of the wearer. The above is a preferred attachment means however, it can be appreciated that alternative means of fastening the airbag to the body of a wearer may be used without departing from the scope of the invention.

Figure 5:
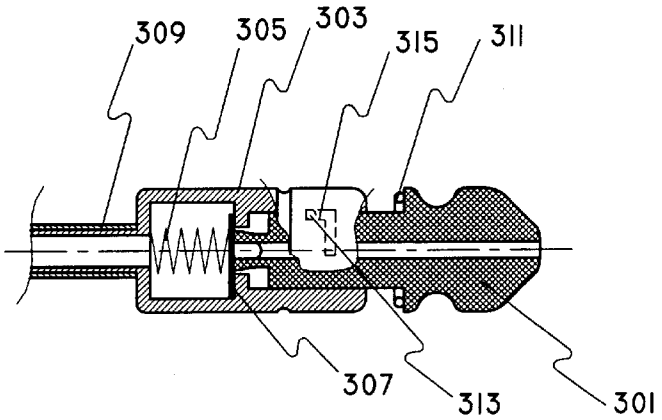
FIG. 5 is a cross sectional view of the air check valve taken from line 1—1 of FIG. 1 (valve is in closed state), in accordance with the present invention.
Figure 7:
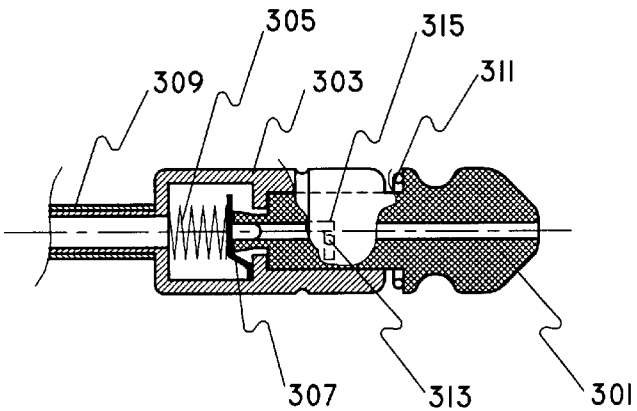
FIG. 7 is the cross sectional view of air check valve taken from line 1—1 of FIG. 1 (valve is in open state), in accordance with the present invention.

The airbag 100 is inflated with air by means of an air filling mechanism 300, shown illustratively at FIG. 1. FIGS. 5 and 7 show the air filling mechanism 300 in greater detail. FIG. 5 illustrates the air filling mechanism 300 in a 'closed' state and FIG. 7 illustrates the air mechanism 300 in an 'open' state.

For inflation of the airbag 100, the air filling mechanism 300 should be in the 'closed' state, as shown in FIG. 7. Herein the air check valve head 301 is positioned adjacent to the air check valve body 303. This positioning facilitates airflow. This position is maintained while air is breathed into the air filling mechanism 300, which then transmits into the air filling tube 309. The air filling tube 309 then channels air through an air filling port 112, which is a coupling between the air filling mechanism 300 and the flexible sheets 101.

Coupling ports 111 and 112 are flanges, which are welded to the top layer 101 (by discussed welding techniques). Port 111 serves as a suction flange coupling to the air pump 400 to deliver air through filling tube 412. The tube 412 is closed at the end by plastic cap 417 to prevent entering water into the tube and airbag. The cap 417 should be taken out and the end of the tube should be kept out of the water during inflating airbag by means of air pump.

For filling the airbag 100 with air, the check valve head 301 must be pressed in with a lateral force by lips or teeth and/or fingers onto the air check valve 303 which in turns opens the air check valve 303 and air can easily pass there through. The check valve head 301 should be released after each exhale. By exhaling breath into the air check valve 303, the airbag 100 will inflate to the extent that is desired by the wearer. O-ring 311 air seals the connection between check valve head 301 and check valve 303 when the check valve head 301 is pressed in onto the air check valve 303 during inflating the airbag 100.

After each exhale for inflating, the check valve head 301 is released which causes the spring 305 to engage the washer 307 and thereby close the body of the check valve 303. The air filling tube 309 may be of any suitable length to reach the mouth of the wearer for convenient inflation and/or deflation while in use.

To deflate the airbag 100, the check valve head 301 is pressed into the check valve body 303 and rotated approximately 45 degrees clockwise until it is in a locked state. After attaining the locked state, locking pin 313 will engage the locking groove 315. In order to deflate the airbag 100 completely, the wearer should gently press the airbag 100 by hands towards his/her body, or keep the airbag 100 between two hands, and press the top layer 101 and the bottom layer 102 of the airbag 100 towards each other.

Adjacent to the air filling mechanism 300 is an air pressure gauge 320. The air pressure gauge 320 comprises a small balloon 325 made of a thin, elastic material and a transparent hollow cylinder 321 and a hole 322 located at the end of the cylinder 321. Gauge lines 323 may be printed on the exterior of the air pressure gauge 320 for indicating air pressure.

Inflation of the airbag 100 will result in an increase in air pressure therein, thus the balloon 325 then increases in length that can be detected by the printed gauge lines 323. The air pressure gauge 320 provides increased safety by aiding in determining whether there may be any sort of puncture or defect in the airbag 100.

Figure 4:
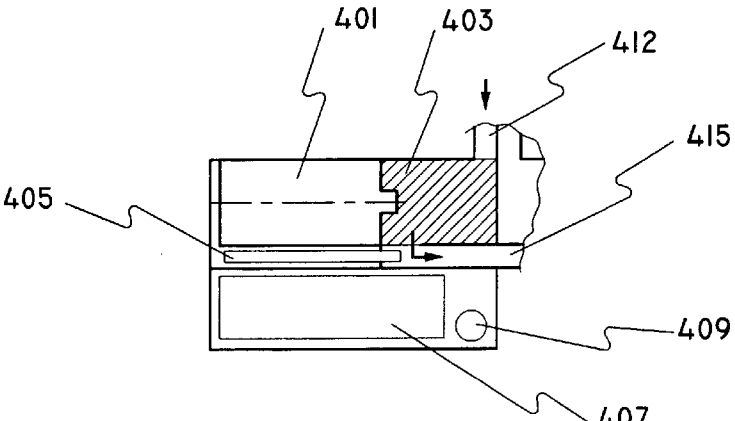
FIG. 4 is a schematic of the air pump in accordance with the present invention.

In an alternate embodiment, the air filling mechanism 300 may employ the use of an air pump 400 in lieu of manual air filling. A battery-operated air pump 400 (shown in phantom in FIG. 1) may be used alternatively to inflate the airbag 100. As shown in FIG. 4, the air pump 400 comprises an air compressor 403, an electric motor 401, an air pressure sensor 405, a rechargeable battery 407, a push button on/off switch 409, suction tube 412 and an outlet tube 415.

The inflation of the airbag 100 may vary depending on the application of the airbag. For instance, if the wearer intends to stay above water, the airbag 100 should be inflated to maximum capacity. Or, if the wearer wishes to swim with more control, the airbag should be inflated partially. The more the airbag 100 is inflated, the more buoyancy will be achieved.

Figure 9:
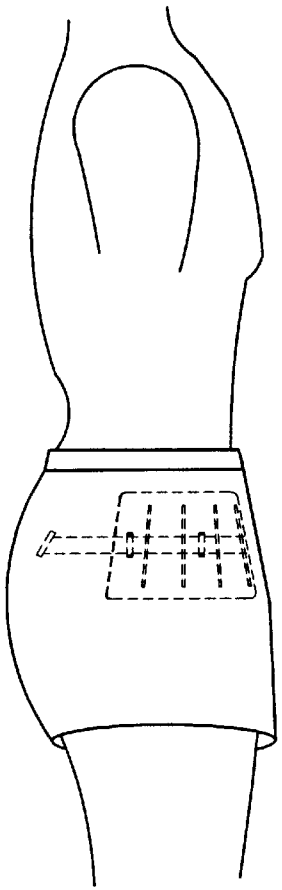
FIG. 9 is a side view of the inventive safety airbag for swimmers placed on the lower abdomen of a male wearer worn beneath swimming apparel, as shown in FIG. 8.
Figure 8:
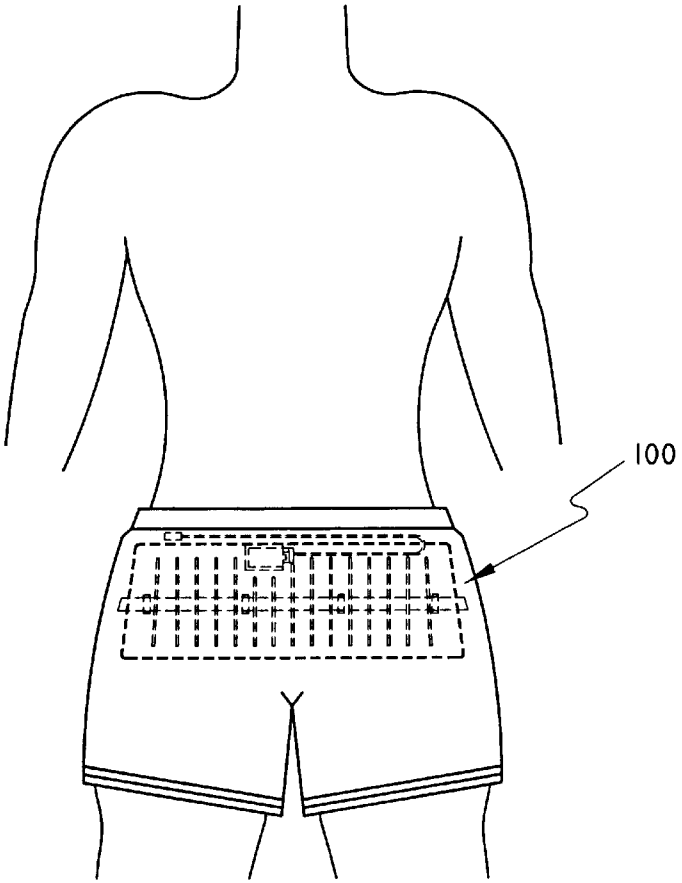
FIG. 8 is a front view of the inventive safety airbag for swimmers placed on the lower abdomen of a male wearer worn beneath swimming apparel.
Figure 12:
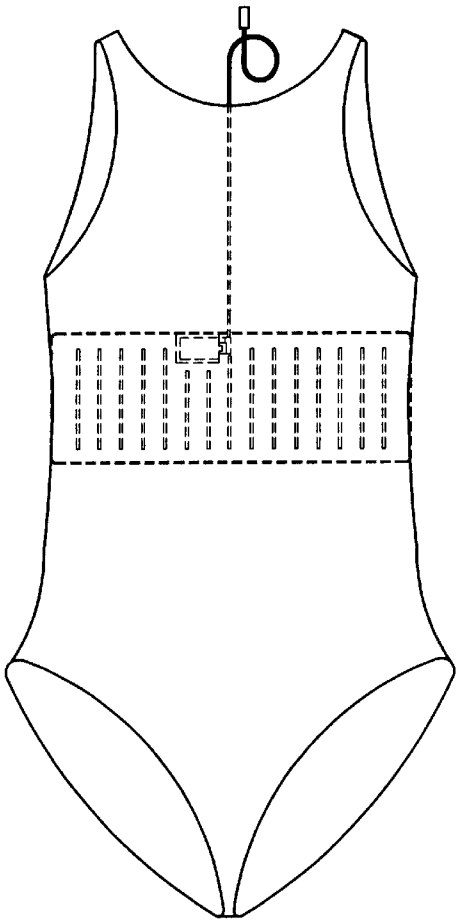
FIG. 12 is a perspective view of the inventive safety airbag for swimmers integrated with traditional female swimwear apparel as shown in FIG. 11.
Figure 11:
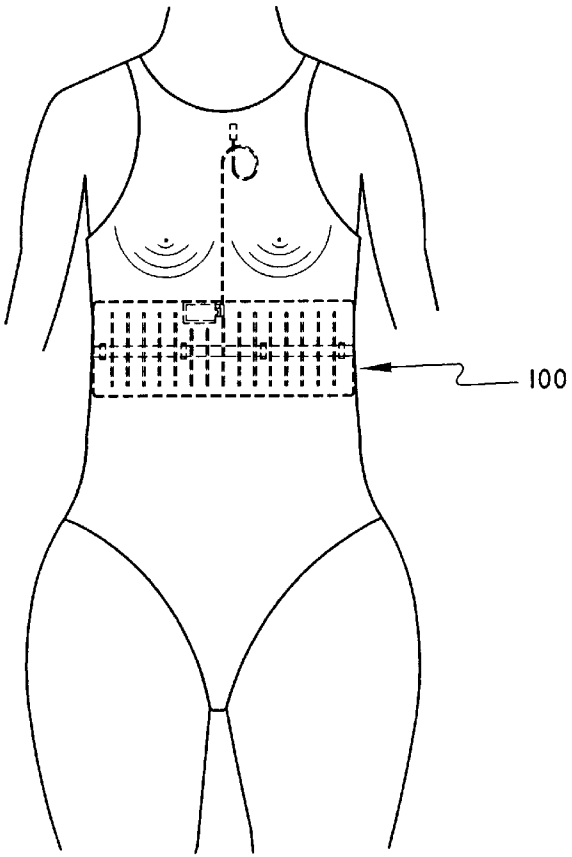
FIG. 11 is a front view of the present invention placed on the rib of a female wearer beneath swimming apparel.

FIGS. 8 and 9 illustrate the airbag 100 as worn by a male user. Herein the airbag 100 is worn beneath swimwear and is placed on the lower abdomen. FIGS. 11 and 12 show the airbag 100 as worn by a female user. Herein, the airbag is worn beneath swimwear and placed on the rib area.

Figure 10:
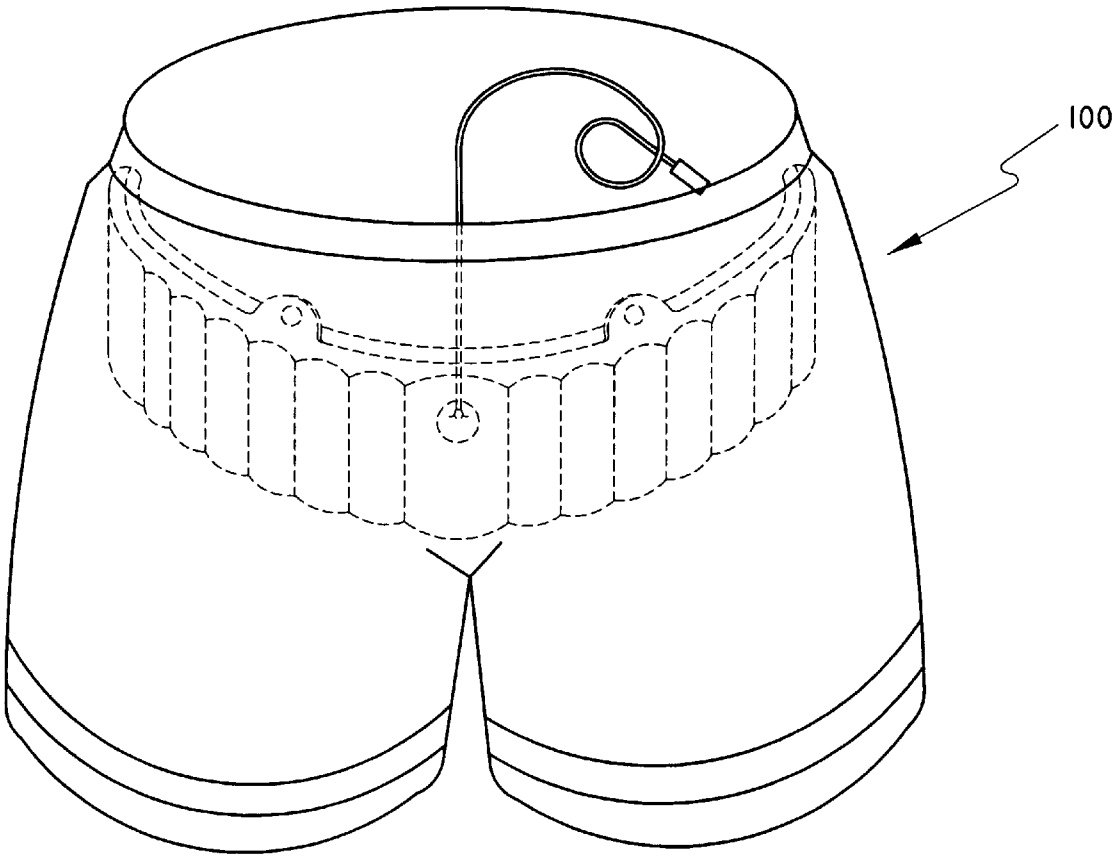
FIG. 10 is a perspective view of the inventive safety airbag for swimmers integrated with traditional male swimwear apparel, as shown in FIG. 8.

The inventive airbag 100 can take on various forms in different embodiments. For example, the airbag 100 has been described thus far as a separate device, however, conceivably the airbag 100 may be incorporated into swimming apparel for both men and women. FIG. 10 shows the airbag 100 integrated in a male swimwear.

Figure 13:
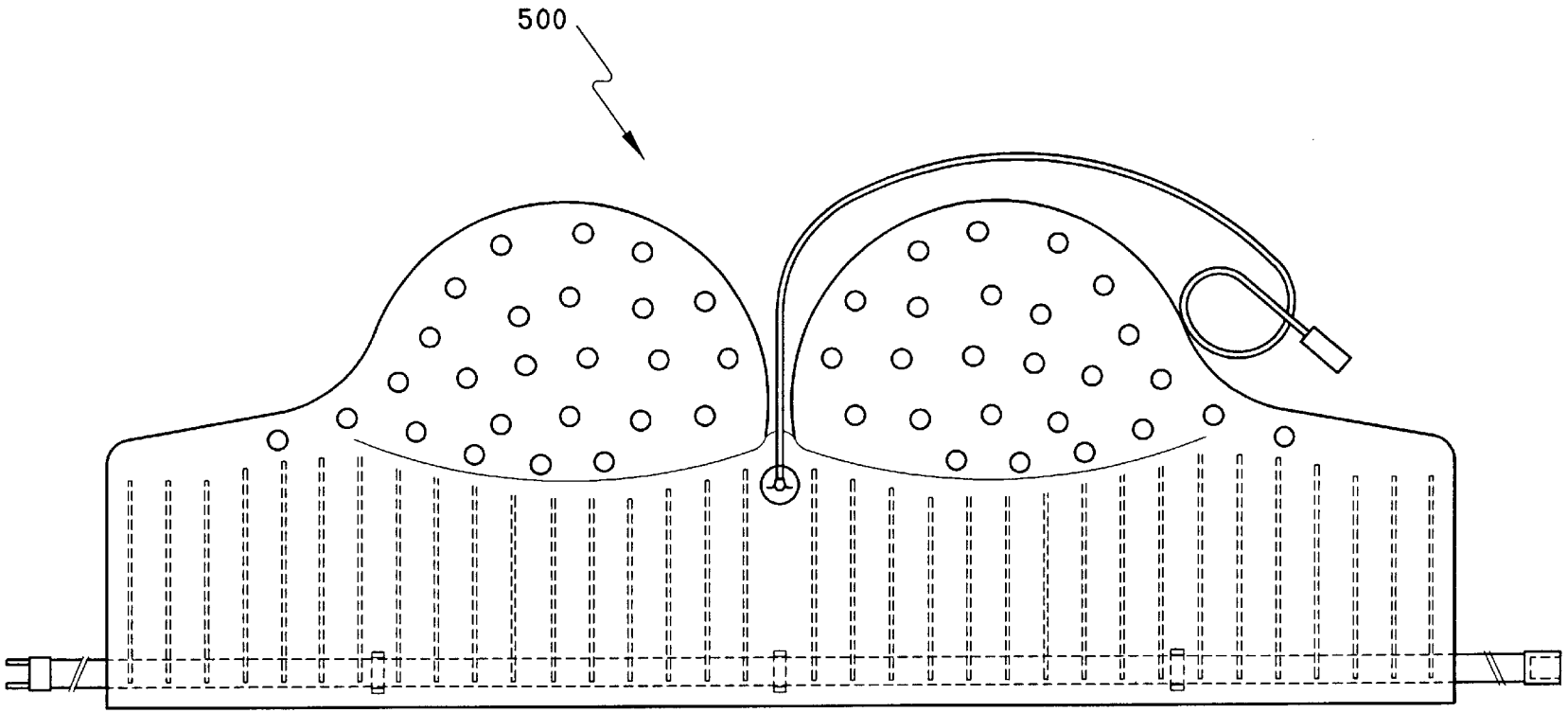
FIG. 13 is a front view of the inventive safety airbag for swimmers designed in the shape of a female bra.
Figure 14:
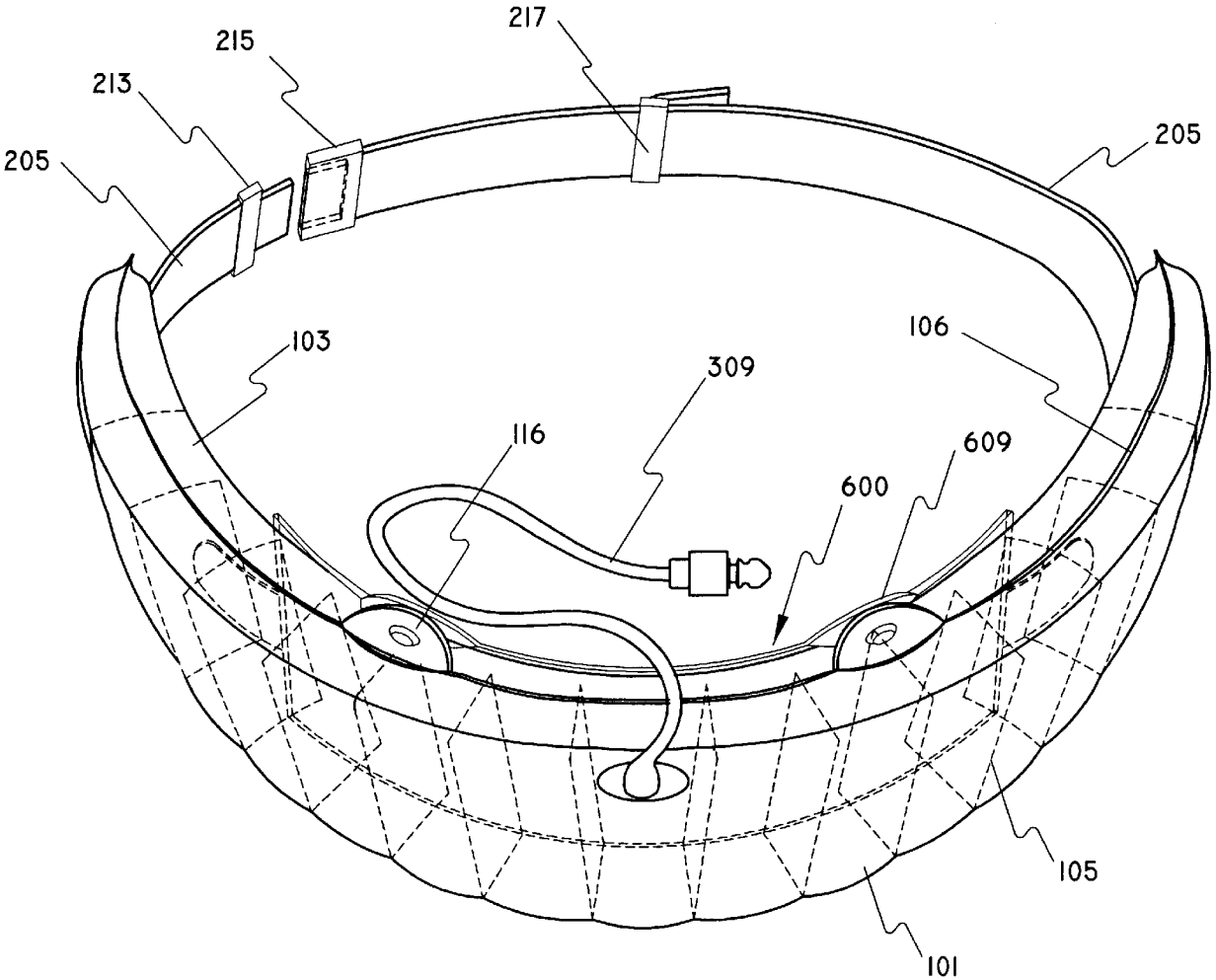
FIG. 14 is a perspective view of the swimmer's neck airbag.

Additionally, FIG. 13 illustrates the airbag 500 configured as a bra to be worn by a female user. The bra-type configuration is advantageous in that it can be worn beneath different types of female swimwear such as bikini styles, or other two-piece styles, while maintaining the advantage of remaining substantially invisible to plain view. Additionally, this bra-type configuration 500 can still be worn in conjunction with the abdomen configuration shown in FIG. 11.

Since other modifications and changes varied to fit a particular operating requirements and environment will be apparent to those skilled in the art, the invention is not considered limited to the example chosen for purposes of disclosure, and covers all changes and modifications which do not constitute a departure from the true spirit and scope of the invention.

For example, the airbag 100 may be inflated by other inflation means such as, for example, a compressed air cartridge or by chemical reaction within a gas generating container for inflating the airbag. Also, the safety airbag for swimmers 100 may be made from a variety of different compositions. Plastic material such as PVC or nylon or polyurethane or composition of rubber and PVC reinforced by poly acrylic cord or composition of PVC and rubber reinforced by poly acrylic cords can be used as the plastic sheets (101 and 102) to make the airbag 100.

The airbag 100 may also be sized and dimensioned to be worn on other parts of the user's body individually or with the main airbag. For example, the main airbag 100 may be worn on the swimmer's abdomen or ribs and a smaller airbag on the swimmer's neck to enhance buoyancy. The volume of the airbag 100 can vary from 0.5 liters up to 11 liters depending on its dimension. Various sizes may be used to fit other body parts, such as the neck. In such cases, maximum buoyancy can be achieved by wearing the alternate sizes on additional body parts.

The air filling mechanism 300 may be made of a transparent plastic and the air filling tube can likewise be formed from a polyethylene or PVC. Additionally, for safety reasons, it is possible to divide the airbag 100 longitudinally into two separate compartments, each having one separate plastic filling tubes, air check valves and air pressure gauges. An embodiment as such enhances safety in that in the event of a puncture to one compartment, a secondary compartment will maintain air pressure thereby allowing the wearer to stay afloat until arriving to safety.

It is evident that other conceivable means of joining the flexible sheets may be employed in lieu of welding, such as but not limited to, gluing, stitching, and the like.

Having thus described the invention, what is desired to be protected by Letters Patent is presented in the subsequent appended claims.

What is claimed is:

1. A safety airbag, dimensioned and configured for various parts of a swimmer's body, to be worn by a swimmer underneath swimming apparel, practically invisible to an onlooker, said airbag comprising:

an airbag body consisting of a first flexible sheet, a second flexible sheet, and an interior flexible sheet, said first and second sheets joined at the periphery thereof to form said airbag body having a hollow interior, said interior sheet located between said first and second sheet and attached thereto; in a predetermined pattern forming air pockets within said hollow interior;

fastening means for attaching said airbag body to a wearer;

air inflation means for filling said hollow interior with air, said air inflation means comprising at least one air tube and an air heck valve, said air check valve having air capacity measurement means for gauging air capacity within said airbag body; and means for coupling said air inflation means to said hollow interior.

2. The safety airbag to be worn by a swimmer as in claim 1 wherein, said fastening means comprises:

a) at least one strap having first and second ends, b) strap coupling means for connecting said strap to said second flexible sheet, c) means for adjusting said strap on a wearer, d) first and second connectors located on both said first and second ends, said connectors adapted to matingly connect to one another.

3. The safety airbag to be worn by a swimmer as in claim 2 wherein, said means for coupling consists of at least one air filling port for channeling air into said hollow interior.

4. The safety airbag to be worn by a swimmer as in claim 3 wherein, said air inflation means comprises air pump means, said air pump means connected to said at least one air filling port.

5. The safety airbag to be worn by a swimmer as in claim 2 wherein, said strap coupling means consists of strap holders enclosing said strap, said strap holders adapted to allow minimal frictional movement of said strap therein.

6. The safety airbag to be worn by a swimmer as in claim 2 wherein, said first flexible sheet, said second flexible sheet and said interior flexible sheet are welded together, said interior flexible sheet welded perpendicularly to said first flexible sheet and said second flexible sheet forming a rectangular pattern of air pockets.

7. The safety airbag to be worn by a swimmer as in claim 2 wherein, said first flexible sheet, said second flexible sheet and said interior flexible sheet are made of plastic.

8. The safety airbag to be worn by a swimmer as in claim 2 wherein, said first flexible sheet, said second flexible sheet and said interior flexible sheet are made of a composition of plastic and rubber materials reinforced by poly acrylic cords.

9. The safety airbag to be worn by a swimmer as in claim 1 wherein, said air capacity measurement means comprises an air gauge consisting of a balloon and a hollow cylinder.

10. The safety airbag to be worn by a swimmer as in claim 9 wherein, said balloon has gauge lines printed thereon for measuring air capacity.

11. The safety airbag to be worn by a swimmer as in claim 1 wherein, the airbag body is shaped in a bra configuration.

12. The safety airbag to be worn by a swimmer as in claim 1 wherein, the airbag body is shaped in a substantially parallelogram configuration.

13. The safety airbag to be worn by a swimmer as in claim 1 wherein, the airbag body comprises of a plurality of air pockets.

14. The safety airbag to be worn by a swimmer as in claim 13 wherein, the airbag body comprises of at least two air pockets.

* * * * *